US010473357B2

(12) United States Patent
Takagi et al.

(10) Patent No.: US 10,473,357 B2
(45) Date of Patent: Nov. 12, 2019

(54) COATING BOOTH AND FLOW-STRAIGHTENING DEVICE

(71) Applicant: TRINITY INDUSTRIAL CORPORATION, Toyota (JP)

(72) Inventors: Yoshifumi Takagi, Chiryu (JP); Masayuki Miyake, Yokkaichi (JP); Takashi Hashimoto, Nagoya (JP)

(73) Assignee: TRINITY INDUSTRIAL CORPORATION, Aichi (JP)

( * ) Notice: Subject to any disclaimer, the term of this patent is extended or adjusted under 35 U.S.C. 154(b) by 0 days.

(21) Appl. No.: 15/779,965

(22) PCT Filed: Jun. 23, 2016

(86) PCT No.: PCT/JP2016/068632
§ 371 (c)(1),
(2) Date: May 30, 2018

(87) PCT Pub. No.: WO2017/110117
PCT Pub. Date: Jun. 29, 2017

(65) Prior Publication Data

US 2018/0347848 A1 Dec. 6, 2018

(30) Foreign Application Priority Data

Dec. 21, 2015 (JP) ..... 2015-248736

(51) Int. Cl.
*F24F 13/08* (2006.01)
*B05B 16/00* (2018.01)
(Continued)

(52) U.S. Cl.
CPC ..... *F24F 13/084* (2013.01); *B05B 16/00* (2018.02); *B05B 16/60* (2018.02); *B05C 15/00* (2013.01);
(Continued)

(58) Field of Classification Search
USPC ..... 118/326, 309, 634; 454/50–55
See application file for complete search history.

(56) References Cited

U.S. PATENT DOCUMENTS 3,138,087 A * 6/1964 Larsson ..... B01D 45/10 96/363
3,911,953 A * 10/1975 Crombie ..... F24F 11/81 137/595
2012/0028562 A1* 2/2012 Heim ..... F16L 55/027 454/255

FOREIGN PATENT DOCUMENTS

CN 203389794 U 1/2014
CN 204182516 U 3/2015
(Continued)

OTHER PUBLICATIONS

Nov. 14, 2018 Chinese Office Action issued in Chinese Patent Application No. 201680070986.7.
(Continued)

*Primary Examiner* — Yewebdar T Tadesse
(74) *Attorney, Agent, or Firm* — Oliff PLC

(57) ABSTRACT

A flow-straightening device at a coupling portion between: an air supply chamber adjacent to a coating chamber and supplying air to the coating chamber via a filter provided at a boundary wall between the air supply chamber and the coating chamber; and an air supply duct supplying air to the air supply chamber in a direction along the boundary wall. When a direction parallel to the boundary wall and perpendicular to the air supply chamber width direction is an air supply chamber depth direction; and a direction perpendicular to the boundary wall is an air supply chamber thickness direction, the device includes a plurality of fins arranged in the air supply chamber width direction and the air supply chamber depth direction and juxtaposed to each other to be spaced apart from each other in the chamber thickness direction.

6 Claims, 13 Drawing Sheets

(51) Int. Cl.

| | |
|---|---|
| ***B05B 16/60*** | (2018.01) |
| ***B05C 15/00*** | (2006.01) |
| ***F24F 7/06*** | (2006.01) |

(52) U.S. Cl.
CPC ..... *F24F 7/065* (2013.01); *F24F 2013/088* (2013.01)

(56) References Cited

FOREIGN PATENT DOCUMENTS

| | | | |
|---|---|---|---|
| CN | 204460636 | U | 7/2015 |
| JP | S59-154368 | U | 10/1984 |
| JP | H01-092258 | U | 6/1989 |
| JP | H06-064757 | U | 9/1994 |
| JP | H07-178360 | A | 7/1995 |
| JP | H10-099749 | A | 4/1998 |
| JP | 2004-257621 | A | 9/2004 |
| JP | 2011-183265 | A | 9/2011 |

OTHER PUBLICATIONS

Sep. 13, 2016 International Search Report issued in International Patent Application No. PCT/JP2016/068632.
Sep. 13, 2016 Written Opinion issued in International Patent Application No. PCT/JP2016/068632.

* cited by examiner

Y

X

COATING BOOTH AND FLOW-STRAIGHTENING DEVICE

TECHNICAL FIELD

The present invention relates to a coating booth in which a coating chamber is supplied with air from an air supply chamber via a filter formed at a boundary wall between the coating chamber and the air supply chamber, and a flow-straightening device used therefor.

BACKGROUND ART

In a conventionally known coating booth of such a kind, an air supply chamber mounted at the ceiling of the booth has a double-layer structure in which a dynamic pressure chamber and a static pressure chamber are stacked one on top of the other. In the coating booth, air from an air supply duct is supplied laterally to the dynamic pressure chamber, and the air in the dynamic pressure chamber is allowed to flow down to enter the static pressure chamber via a flow-straightening plate, so that the air becomes less prone to become turbulent (for example, see Patent Literature 1).

CITATIONS LIST

Patent Literature 1: Japanese Patent Application Publication No. 10-99749 (paragraph [0011], FIG. 1)

SUMMARY OF INVENTION

Technical Problems

However, the above-described conventional coating booth has a problem that the air supply chamber is great in size due to the double-layer structure of the air supply chamber. In order to cope with the problem, it has been proposed to employ a single-layer structure air supply chamber, with a bag filter attached to an air inlet introducing air into the air supply chamber. However, this method incurs other problem, that is, high running costs.

The present invention has been made in view of the above-described circumstances, and an object of the present invention is to provide a coating booth with a downsized air supply chamber and reduced running costs, and a flow-straightening device used therefor.

Solutions to Problems

A flow-straightening device according to one aspect of the present invention made to achieve the above-described object is provided at a coupling portion between: an air supply chamber adjacent to a coating chamber and supplying air to the coating chamber via a filter provided at a boundary wall between the air supply chamber and the coating chamber; and an air supply duct supplying air to the air supply chamber in a direction along the boundary wall. When a depth direction of the air supply chamber as seen from the air supply direction from the air supply duct is an air supply chamber depth direction; a direction parallel to the boundary wall and perpendicular to the air supply chamber depth direction is an air supply chamber width direction; and a direction perpendicular to the boundary wall is an air supply chamber thickness direction, the flow-straightening device includes a plurality of fins extending in the air supply chamber width direction and the air supply chamber depth direction and juxtaposed to each other to be spaced apart from each other in the air supply chamber thickness direction.

DESCRIPTION OF EMBODIMENTS

First Embodiment

Figure 1:
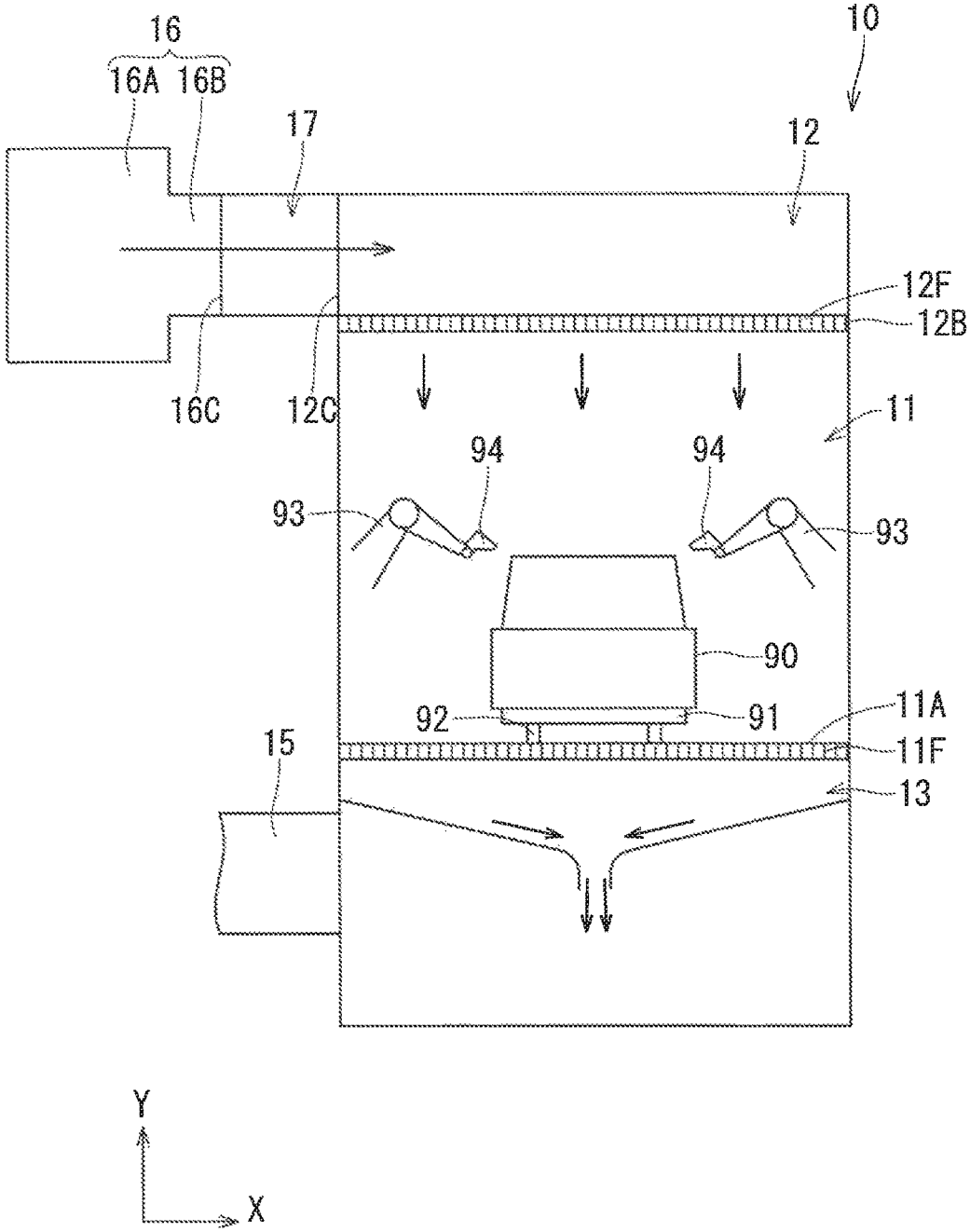
FIG. 1 is a front view of a coating booth according to a first embodiment of the present invention.

Hereinafter, with reference to FIGS. 1 to 8, a description will be given of a first embodiment of the present invention. As shown in FIG. 1, a coating booth 10 according to the present embodiment is for blowing paint to a vehicle body 90 as a workpiece to form a coat on the surface of the vehicle body 90. The coating booth 10 is provided with a coating chamber 11 for performing coating on the vehicle body 90, an air supply chamber 12 provided on a upper side of the coating chamber 11 for supplying downflow air to the coating chamber 11, and an exhaust chamber 13 provided under the coating chamber 11 for exhausting air from the coating chamber 11.

At a floor wall 11A of the coating chamber 11, a grating-like filter 11F is provided. On the floor wall 11A, a conveyor 92 for conveying the vehicle body 90 loaded on a carriage 91 is provided. Further, the coating chamber 11 is provided with coating robots 93 on the right and left sides relative to the conveyor 92, respectively. The vehicle body 90 is coated with paint by coating devices 94 mounted on the coating robots 93.

The exhaust chamber 13 sucks air in the coating chamber 11 with a not-shown exhaust fan. An exhaust duct 15 for exhausting air purified in the exhaust chamber 13 to the outside is provided at the side wall of the exhaust chamber 13.

Figure 2:
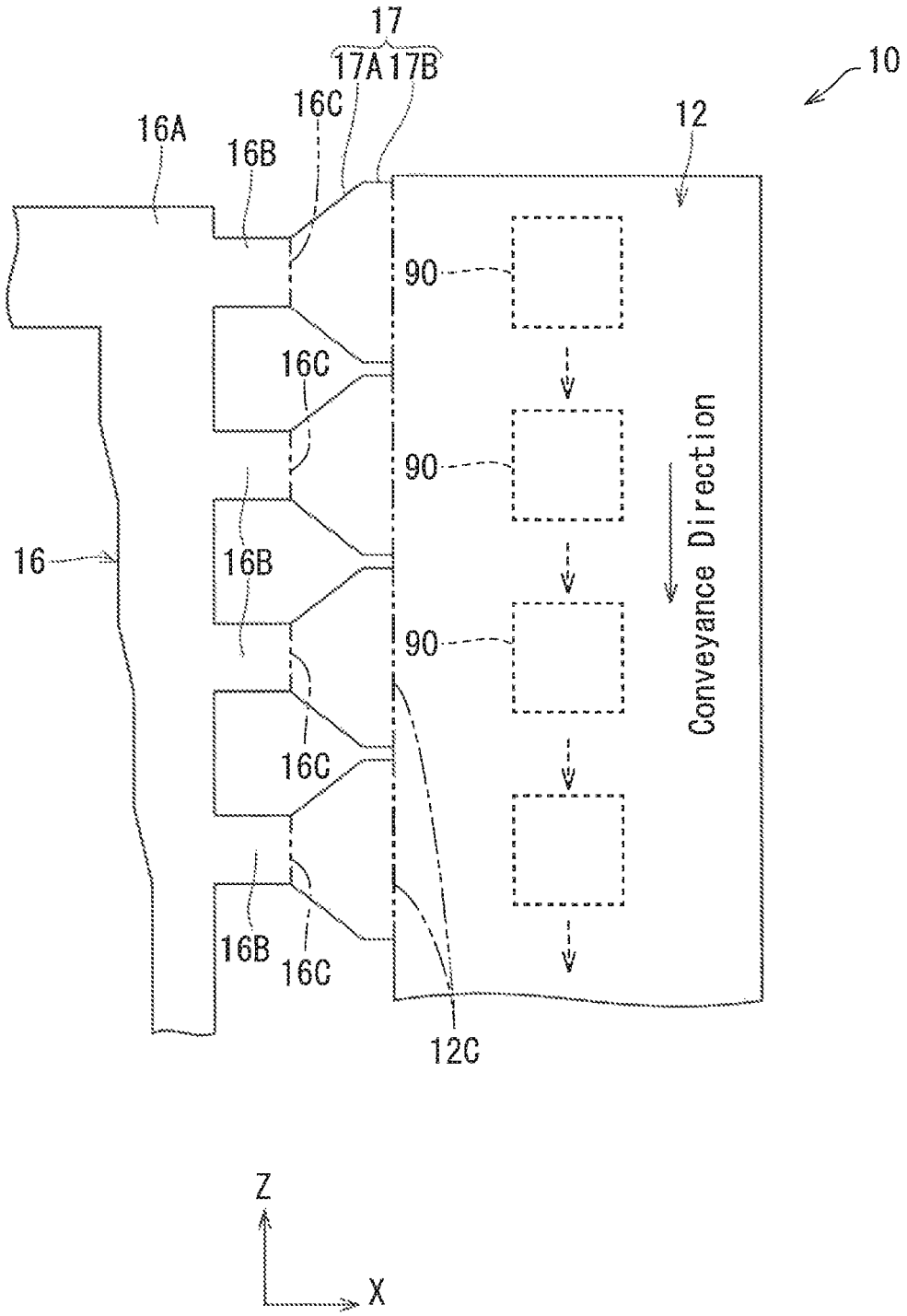
FIG. 2 is a horizontal section view of an air supply chamber.
Figure 3:
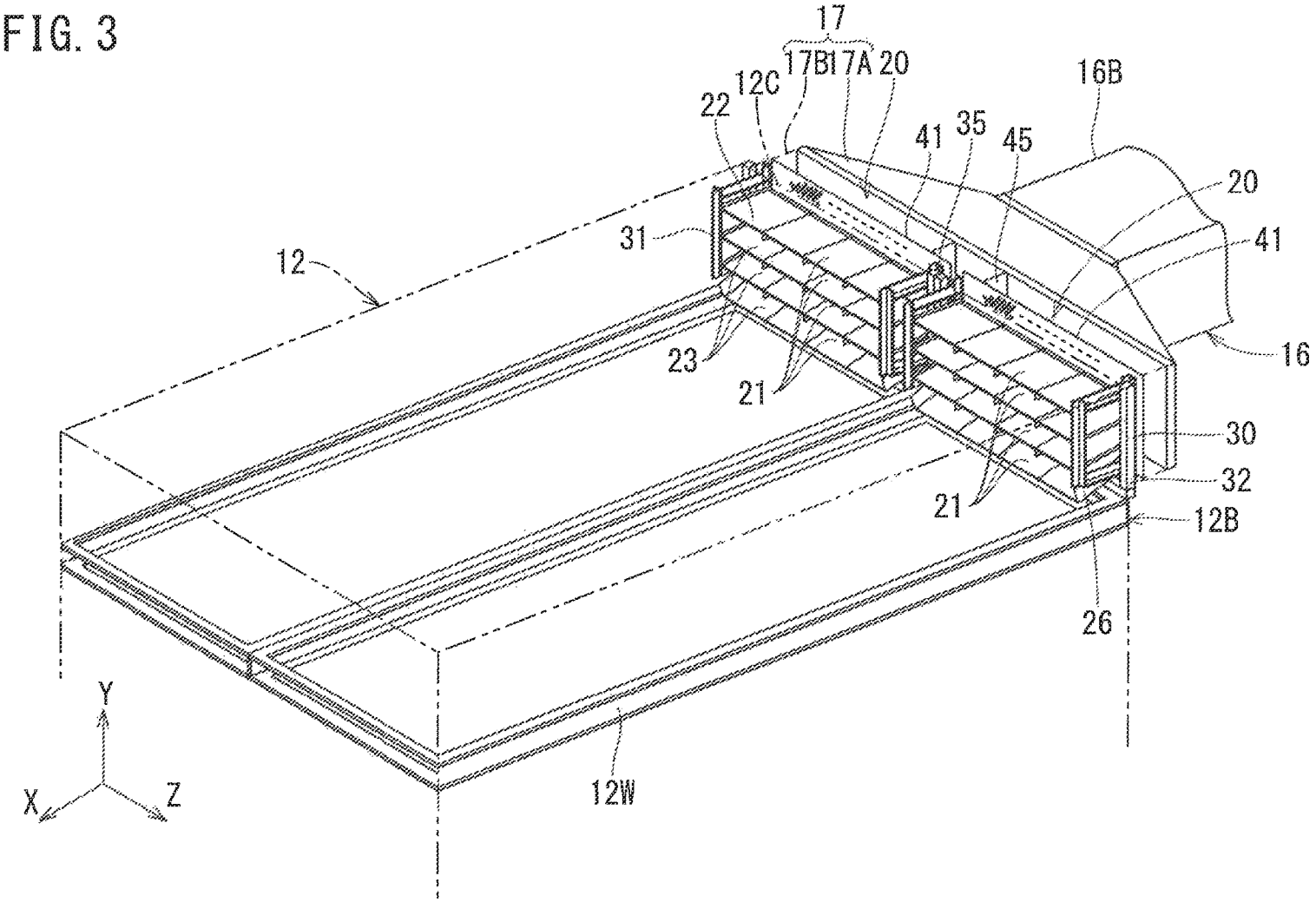
FIG. 3 is a perspective view of the air supply chamber.

As shown in FIGS. 2 and 3, the air supply chamber 12 is supplied with air from an air supply duct 16. The air supply duct 16 is disposed on one side in a direction perpendicular to the conveyance direction of the vehicle body 90 relative to the air supply chamber 12 (that is, in the short-side direction of the coating booth 10), and includes a main pipe 16A extending in the conveyance direction of the vehicle body 90 (that is, the long-side direction of the coating booth 10), and a plurality of branch pipes 16B branching off from the main pipe 16A to project toward the air supply chamber 12. The end of each of the branch pipes 16B constitutes a vent 16C. At the end of each of the branch pipes 16B, wind volume adjusting dampers 16D for adjusting the volume of air blown from the vent 16C are provided (see FIG. 4).

As shown in FIG. 1, a filter 12F (for example, a nonwoven fabric filter) is provided at a floor wall 12B (corresponding to the "boundary wall" of the present invention) of the air supply chamber 12. In more detail, as shown in FIG. 3, a filter frame 12W is provided at the floor wall 12B, and the filter 12F (not shown in FIG. 3) is attached inside the filter frame 12W. Further, as shown in FIG. 2, air inlets 12C opposing to the vents 16C are formed in the air supply chamber 12. Note that, in the present embodiment, the center of each vent 16C and the center of each air inlet 12C substantially coincide with each other in the long-side direction of the coating booth 10.

Here, in the present embodiment, a thickness direction Y perpendicular to the floor wall 12B of the air supply chamber 12 (that is, the height direction of the coating booth 10) corresponds to the "air supply chamber thickness direction" in the present invention; a depth direction X of the air supply chamber 12 as seen from the vents 16C (that is, the short-side direction of the coating booth 10) corresponds to the "air supply chamber depth direction" of the present invention; and a width direction Z perpendicular to the depth direction X in the horizontal plane (that is, the long-side direction of the coating booth 10) corresponds to the "air supply chamber width direction" of the present invention. Hereinafter, unless otherwise specified, the depth of the air supply chamber 12 refers to the length in the depth direction X, and the width of the air supply chamber 12 refers to the length in the width direction Z. Further, in FIGS. 1 to 8, the thickness direction Y, the depth direction X, and the width direction Z of the air supply chamber 12 are respectively indicated by "X", "Y", and "Z".

The vents 16C of the branch pipes 16B and the air inlets 12C of the air supply chamber 12 are coupled to each other with coupling ducts 17. Here, in the present embodiment, each air inlet 12C of the air supply chamber 12 is wider than each vent 16C of the air supply duct 16. In each coupling duct 17, a hopper part 17A (corresponding to the "channel widened part" of the present invention) is formed in a trapezoidal shape as seen in a plan view, increasing its channel width toward the downstream side. Specifically, the coupling duct 17 is structured of the hopper part 17A, and a straight part 17B disposed downstream to the hopper part 17A and having a constant channel width. The hopper part 17A communicates with the vent 16C, and the straight part 17B communicates with the air inlet 12C. Note that, in the example of the present embodiment, the hopper part 17A and the straight part 17B are constant and identical to each other in height.

Figure 4:
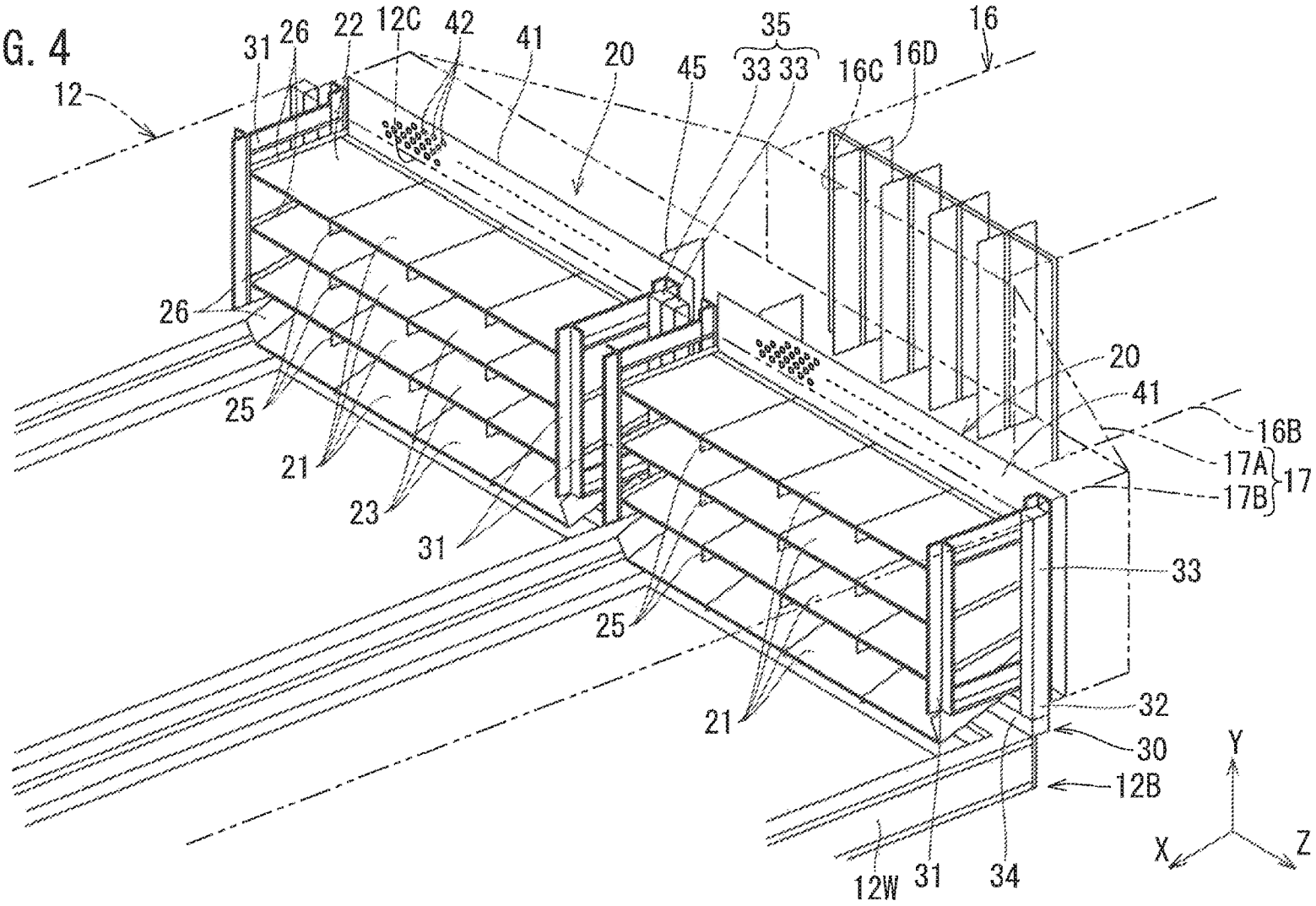
FIG. 4 is a perspective view of a flow-straightening device.

As shown in FIGS. 3 and 4, in the coating booth 10 according to the present embodiment, in order to straighten the flow of air from the vents 16C to the air supply chamber 12, flow-straightening devices 20 are provided at each coupling duct 17. In more detail, the flow-straightening devices 20 are attached to the straight part 17B of each coupling duct 17, and the flow-straightening devices 20 partially project into the air supply chamber 12 from the air inlet 12C.

The flow-straightening devices 20 each include a plurality of fins 21, and a supporting member 30 supporting the plurality of fins 21. The supporting member 30 includes a fixed base 32 fixed to the end of the straight part 17B of the coupling duct 17, and a pair of supporting frames 31, 31 projecting from the fixed base 32 into the air supply chamber 12 to support the plurality of fins 21. The fixed base 32 has a frame-like shape abutting on the opening edge of the air inlet 12C of the air supply chamber 12, and includes a pair of support struts 33, 33, and a pair of beam members 34, 34 connecting between opposite ends of the pair of support struts 33, 33 (FIGS. 3 and 4 and FIGS. 6 to 8 do not show the upper beam member 34). The pair of supporting frames 31, 31 projects from the fixed base 32 into the air supply chamber 12, and opposes to each other in the width direction Z of the air supply chamber 12. The plurality of fins 21 are held between the pair of supporting frames 31, 31.

Figure 5:
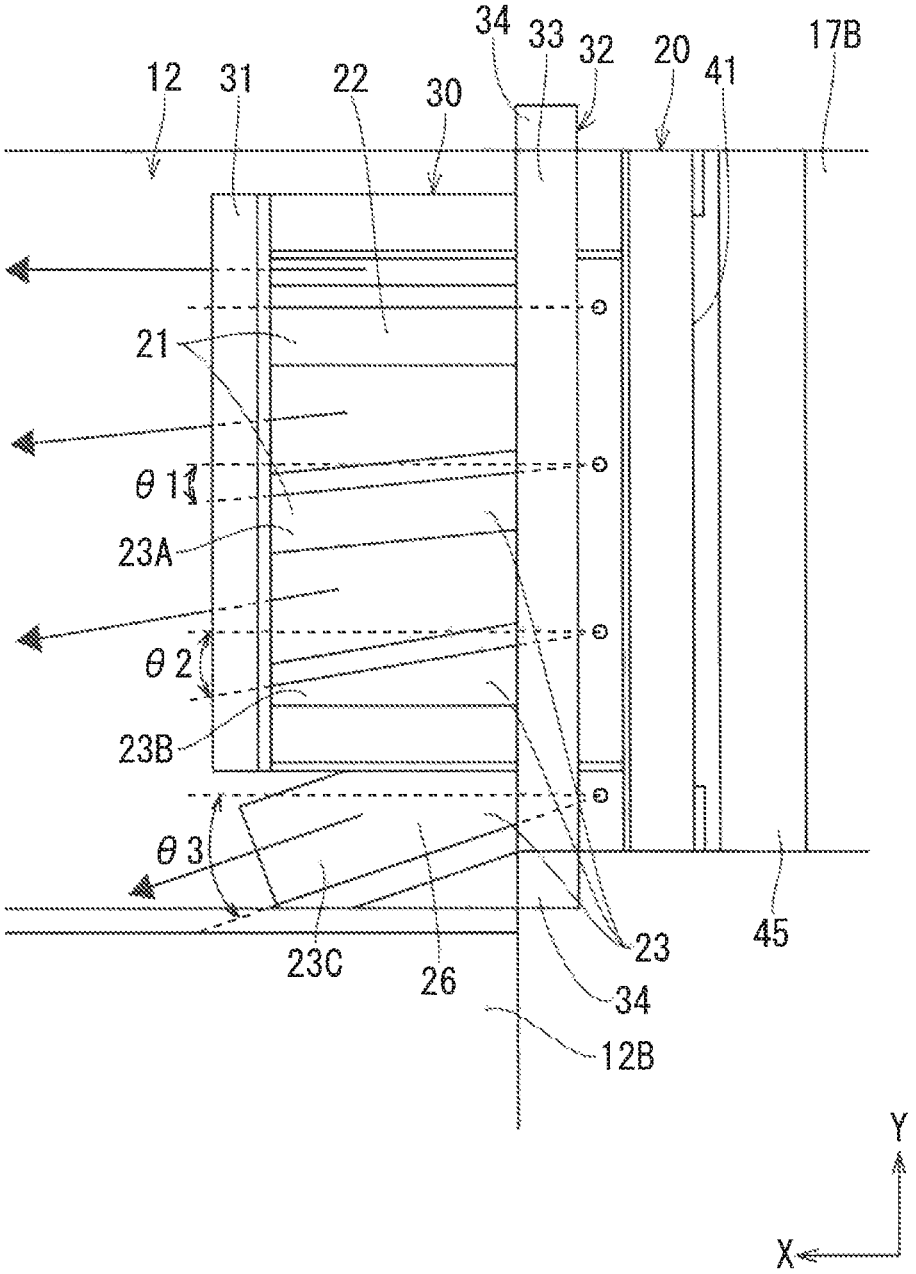
FIG. 5 is a side view of the flow-straightening device.

The plurality of fins 21 extend along both the width direction Z and the depth direction X of the air supply chamber 12, and are juxtaposed to be spaced apart from each other in the thickness direction Y of the air supply chamber 12. As shown in FIG. 5, the plurality of fins 21 are different from each other in the tilt angle relative to the horizontal plane. Specifically, the fin 21 disposed highest is a first fin 22 substantially horizontally disposed, and the fins 21 disposed lower than the highest fin 21 are second fins 23 which tilt downward with increases in a distance in the depth direction of the air supply chamber 12.

In the flow-straightening device 20 according to the present embodiment, the plurality of second fins 23 are provided. In the plurality of second fins 23, a second fin 23 disposed lower is greater in the tilt angle relative to the horizontal plane than a second fin 23 disposed higher. In the example shown in FIG. 5, three second fins 23 are provided. In the second fins 23, a tilt angle θ2 relative to the horizontal plane of a second middle level fin 23B disposed second highest is greater than a tilt angle θ1 relative to the horizontal plane of a second upper level fin 23A disposed highest, and a tilt angle θ3 relative to the horizontal plane of a second lower level fin 23C disposed lowest is greater than the tilt angle θ2. Note that, the plurality of fins 21 (the first fin 22 and the second fins 23) are, for example, pivotally supported by supporting projections (not shown) projecting from the supporting frame 31 in the width direction Z of the air supply chamber 12, and is structured to be capable of properly adjusting the tilt angle relative to the horizontal plane of the second fins 23.

In this manner, in the flow-straightening device 20 according to the present embodiment, the first fin 22 disposed highest is disposed substantially horizontal, and the plurality of second fins 23 disposed lower than the first fin 22 tilt downward with increases in a distance in the depth direction of the air supply chamber 12. In the plurality of second fins 23, a second fin 23 disposed lower is greater in the tilt angle relative to the horizontal plane than a second fin 23 disposed higher. Thus, the flow-straightening device 20 is capable of causing the air flowing along a fin 21 disposed higher to flow downward at a point farther in the depth direction of the air supply chamber 12, and causing the air flowing along a fin 21 disposed lower to flow downward at a point nearer in the depth direction of the air supply chamber 12 (see arrows in FIG. 5). As a result, the air supplied from the vent 16C to the air supply chamber 12 can be dispersed in the depth direction X of the air supply chamber 12, and the air is caused to flow downward from the entire air supply chamber 12.

Figure 6:
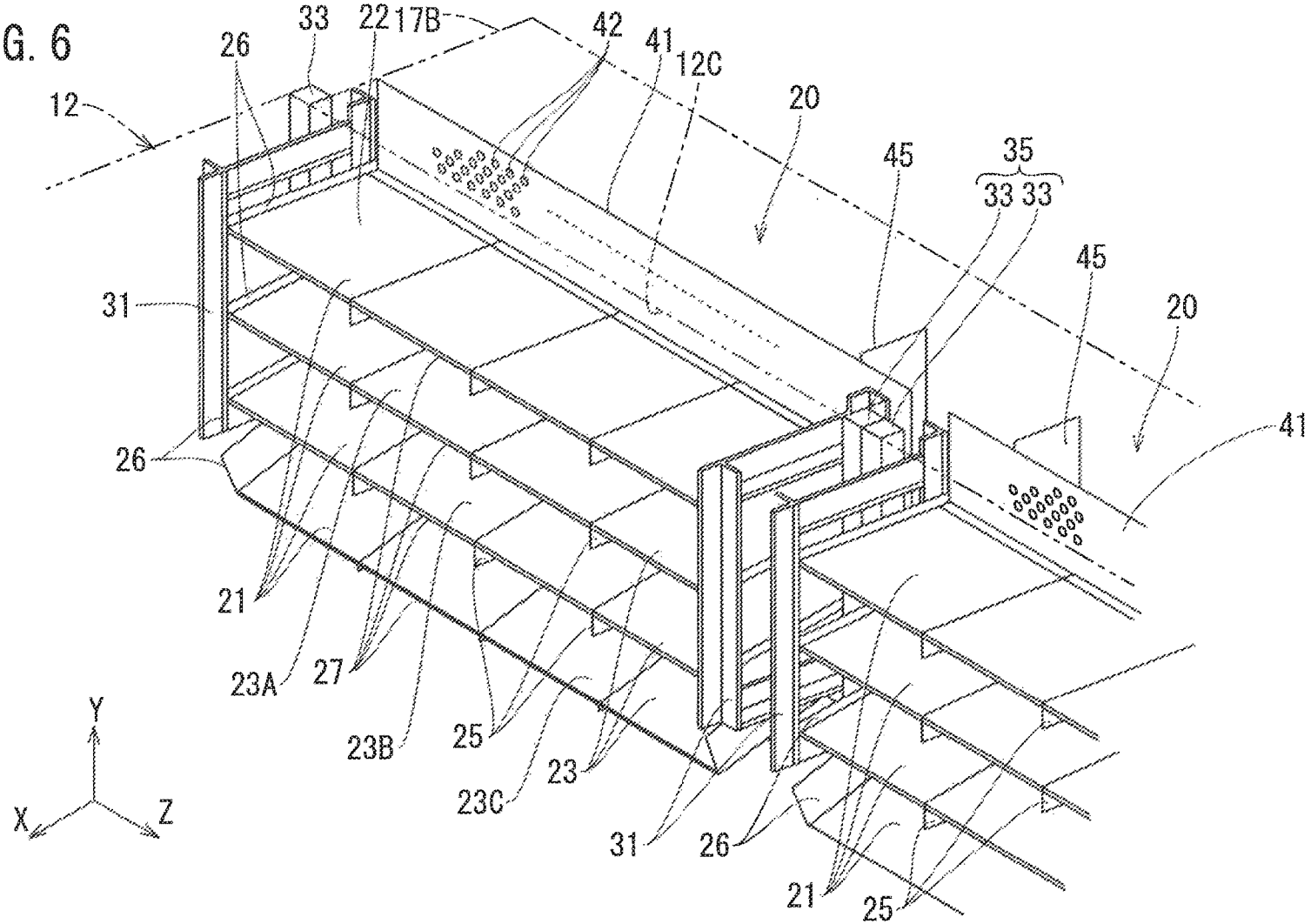
FIG. 6 is a perspective view of a plurality of fins.

As shown in FIG. 6, at the middle in the width direction of each of the fins 21, a plurality of reinforcing intermediate ribs 25 are provided. The plurality of intermediate ribs 25 extend in the depth direction X of the air supply chamber 12, and are capable of guiding the air passing through the fins 21 in the depth direction of the air supply chamber 12. In this manner, in the flow-straightening device 20 according to the present embodiment, the intermediate ribs 25 have the two functions of reinforcing the fins 21 and straightening the flow of air.

In more detail, the plurality of intermediate ribs 25 project downward, to straighten the flow of air passing beneath the fins 21 in the depth direction of the air supply chamber 12. Further, the plurality of intermediate ribs 25 are disposed at regular intervals in the width direction Z of the air supply chamber 12. Note that, the projection height of the intermediate ribs 25 at the fin 21 disposed lowest, that is, at the second lower level fin 23C, is smaller than the projection height of the intermediate ribs 25 of the fins 21 disposed higher than the second lower level fin 23C. This structure avoids interference between the filter 12F provided at the floor wall 12B of the air supply chamber 12 and the intermediate ribs 25.

Further, at the opposite ends of each fin 21 in the width direction Z of the air supply chamber 12, sidewalls 26, 26 formed by folding the fin 21 are provided. Specifically, the sidewalls 26 are formed by folding each fin 21, so that air passing above the fin 21 becomes less prone to deviate outside the fin 21 in the width direction Z of the air supply chamber 12. Note that, in the present embodiment, the intermediate ribs 25 and the sidewalls 26 correspond to the "flow-straightening projection wall" of the present invention.

Here, as described above, in the plurality of second fins 23, a second fin 23 disposed lower is greater in the tilt angle relative to the horizontal plane (see FIG. 5). The interval between the second fin 23 disposed lowest and the second fin 23 disposed second lowest is greater than the interval between other fins 21, 21. Accordingly, air flowing above the fin 21 disposed lowest, that is, the second lower level fin 23C, is prone to deviate outside the fin 21. Therefore, in the flow-straightening device 20 according to the present embodiment, the projection height of the sidewalls 26, 26 at the second lower level fin 23C is greater than the projection height of the sidewalls 26, 26 at the fins 21 disposed higher than the second lower level fin 23C. Note that, in the second lower level fin 23C, interference between the sidewalls 26 and the filter 12F is avoided by the sidewalls 26, 26 projecting upward similarly to the intermediate ribs 25.

As shown in FIG. 6, each fin 21 is provided with a claw 27 formed by folding the front end of the fin 21, for reinforcing the fin 21. In more detail, the claw 27 of the fin 21 disposed lowest is formed by folding the front end of the fin 21 upward, so as to avoid interference with the filter 12F. The claw 27 of each of the fins 21 disposed higher than the lowest fin 21 is formed by folding the front end of the fin 21 downward. Note that, the height of the claws 27 is smaller than that of the intermediate ribs 25 and the sidewalls 26.

As shown in FIG. 4, the flow-straightening device 20 includes a perforated plate 41 (corresponding to the "porous plate" of the present invention) covering the plurality of fins 21 from the vent 16C side, that is, from the upstream side. At the perforated plate 41, a plurality of through holes 42 are formed (FIGS. 3, 4, and 6 show only part of the through holes 42, and FIG. 8 does not show the through holes 42). In the present embodiment, by the plurality of fins 21 being covered with the perforated plate 41 from the upstream side, the velocity of the airflow passing through the plurality of fins 21 is reduced, whereby noise can be reduced. Further, in the present embodiment, by virtue of provision of the perforated plate 41, it is possible to diffuse air blown from the vent 16C inside the hopper part 17A and to supply air over the entire width direction Z of the air supply chamber 12. Note that, the perforated plate 41 is provided across the ceiling wall and the bottom wall of the coupling duct 17 (in more detail, the straight part 17B).

Here, in the present embodiment, the hole-opening ratio of the perforated plate 41 substantially coincides with an inverse of the widening ratio of the channel width of the hopper part 17A. This structure makes it possible to coincide the amount of air supplied from the vent 16C and the amount of air passing through the perforated plate 41 with each other, and to render air less prone to become turbulent. In the example of the present embodiment, the through holes 42 are circular, but may be oval or polygonal.

Meanwhile, in the flow-straightening device 20, the plurality of fins 21 are supported by the pair of supporting frames 31, 31 of the supporting member 30. Accordingly, when the fins 21 have a great width, the plurality of fins 21 are hardly supported by the pair of supporting frames 31, 31. Therefore, when the air supply chamber 12 has a great width, it is difficult for just one flow-straightening device 20 to straighten the flow of air supplied from the air supply duct 16. In view of the foregoing, in the coating booth 10 according to the present embodiment, as shown in FIGS. 3 and 4, a pair of the flow-straightening devices 20 are provided in the width direction Z of the air supply chamber 12. Thus, even in the case where the air supply chamber 12 is great in width, the flow-straightening devices 20 can be disposed over the entire width direction Z of the air supply chamber 12.

Figure 7:
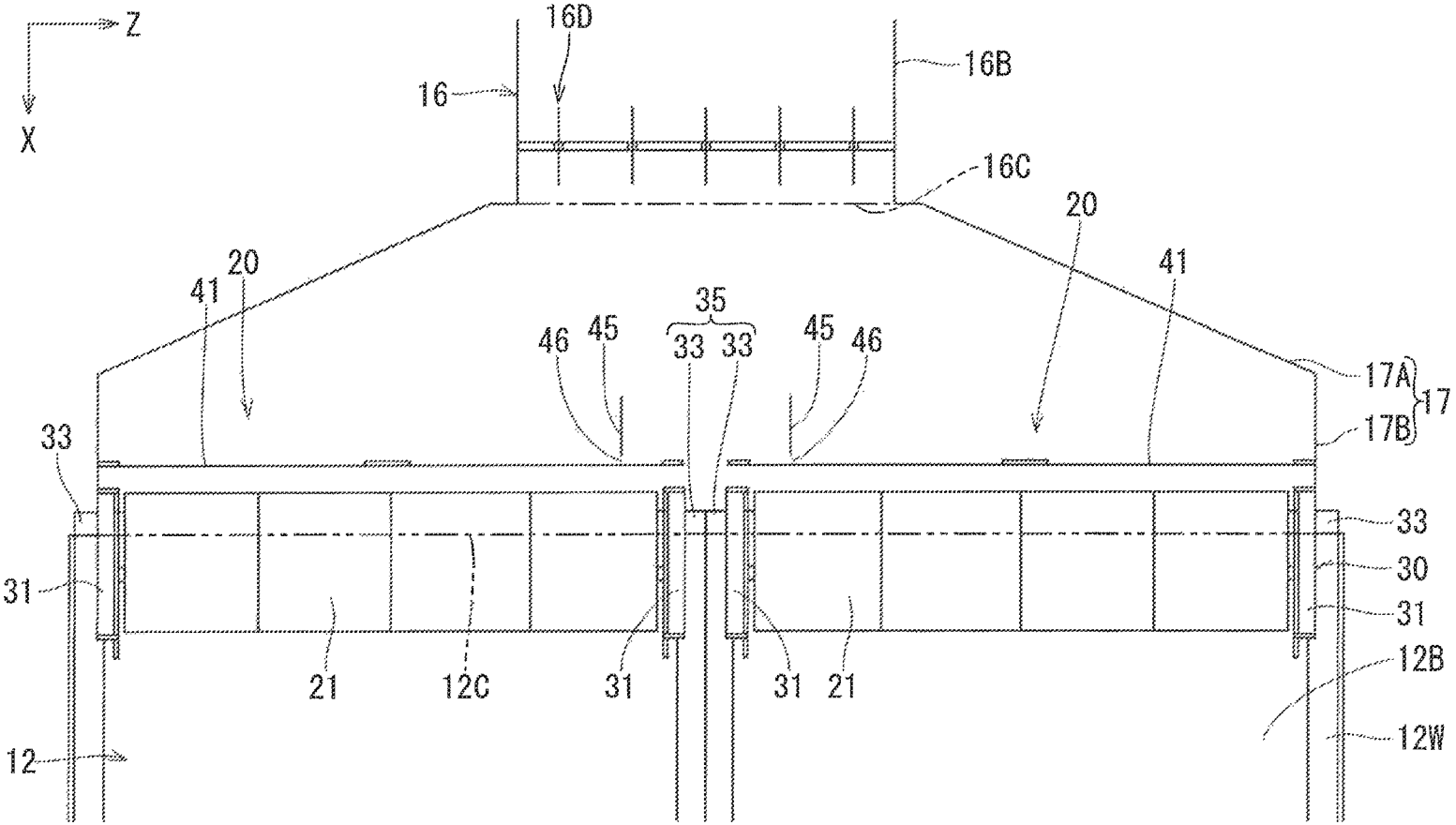
FIG. 7 is a plan view of the flow-straightening device.
Figure 8:
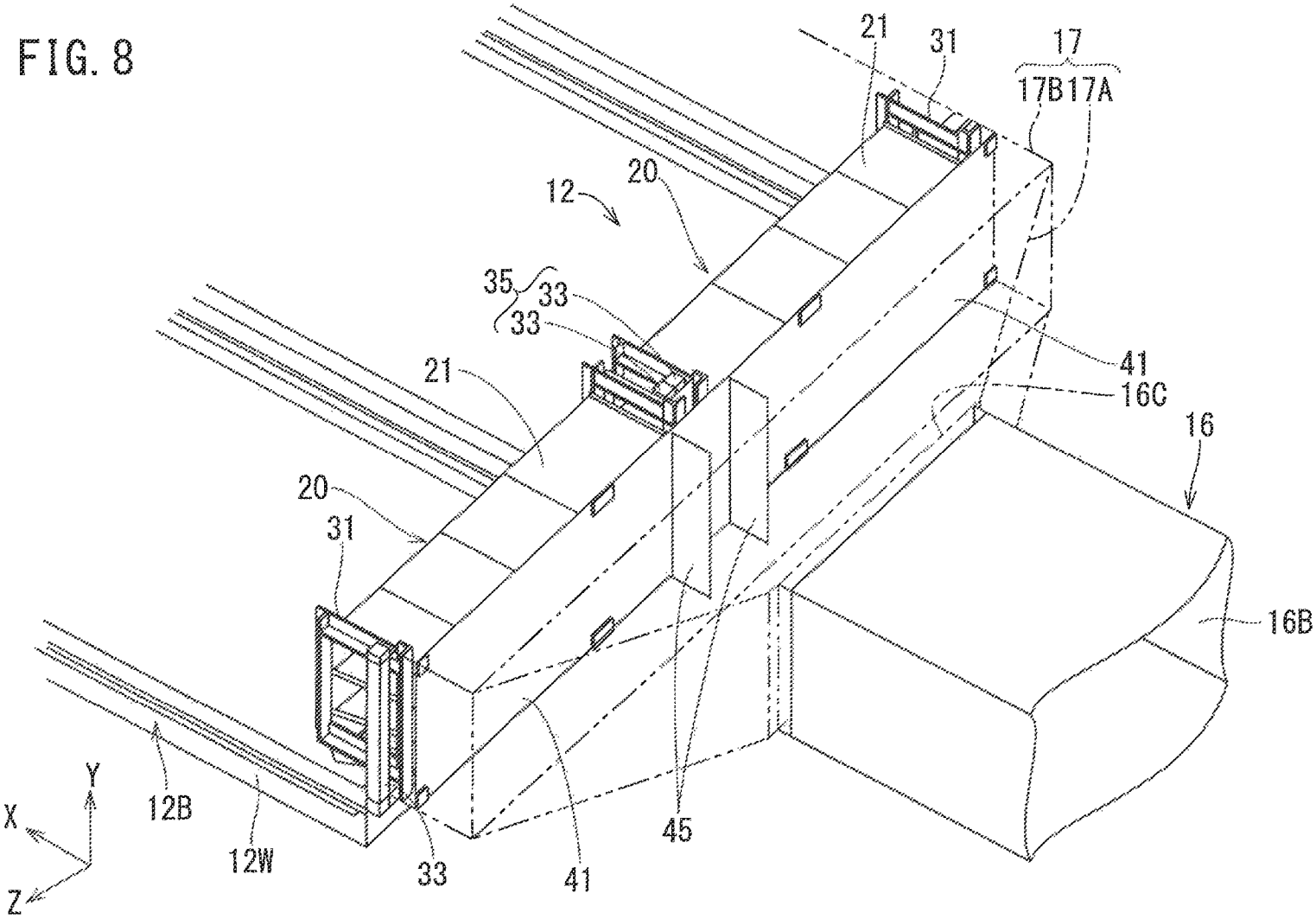
FIG. 8 is a perspective view of the flow-straightening device as seen from an air supply duct side.

As shown in FIG. 7, at the opposite ends of each flow-straightening device 20 in the width direction Z of the air supply chamber 12, the above-described support struts 33, 33 of the fixed base 32 are disposed. Each support strut 33 has a shape of a quadrangular cylinder. At the boundary portion of the pair of flow-straightening devices 20, 20, a blocking wall 35 is formed for blocking air flowing from the vent 16C by adjacently arranging the support struts 33 of respective flow-straightening devices 20. In this manner, in the coating booth 10 according to the present embodiment, the blocking wall 35 prevents entry of air into the air supply chamber 12 from the clearance between the flow-straightening devices 20, 20.

Here, when the air supplied from the air supply duct 16 is blocked by the blocking wall 35, there arises a problem that eddy flow occurs on the downstream side of the blocking wall 35. In order to prevent occurrence of the eddy flow, in each flow-straightening device 20 according to the present embodiment, a guide plate 45 is provided upstream to the blocking wall 35, for guiding the air in the depth direction X of the air supply chamber 12.

Specifically, the guide plates 45 are positioned upstream to the blocking wall 35 and the perforated plates 41, and are provided in a pair in such a manner as to interpose the blocking wall 35 therebetween in the width direction Z of the air supply chamber 12. Further, between the guide plates 45 and the perforated plates 41, gaps 46 are respectively formed. This structure prevents occurrence of noises attributed to any contact between the guide plates 45 and the perforated plates 41. The gaps 46 has a size enough to avoid contact between the guide plates 45 and the perforated plates 41, and is fully small, for example, about 1/10 as large as, or smaller than, the length of each guide plate 45 in the depth direction X of the air supply chamber 12. Note that, the guide plates 45 are attached to the coupling duct 17 (in more detail, to the straight part 17B), and disposed across the ceiling wall and the bottom wall of the coupling duct 17.

The foregoing is the description of the structure of the coating booth 10 and the flow-straightening device 20 according to the present embodiment. Next, a description will be given of the operation and effect of the coating booth 10 and the flow-straightening device 20.

In the coating booth 10 and the flow-straightening device 20 according to the present embodiment, the air from the air supply duct 16 is supplied to the air supply chamber 12 in the direction along the floor wall 12B of the air supply chamber 12, and supplied inside the coating chamber 11 via the filter 12F at the floor wall 12B. Here, at the coupling duct 17 coupling between the air supply duct 16 and the air supply chamber 12, the flow-straightening devices 20 are provided. The flow-straightening devices 20 each include a plurality of fins 21 disposed in the depth direction X and the width direction Z of the air supply chamber 12 as being spaced apart from each other in the thickness direction Y perpendicular to the floor wall 12B of the air supply chamber 12. Thus, in the coating booth 10, the flow of air passing between the fins 21 is straightened so as to flow in the depth direction of the air supply chamber 12 in a layered manner. Thus, the air inside the air supply chamber 12 becomes less prone to become turbulent. In this manner, the coating booth 10 and the flow-straightening devices 20 of the present embodiment straighten the flow of air supplied from the air supply duct 16 in the air supply chamber 12 without the necessity of employing the air supply chamber 12 of the two-layer structure as in the conventional coating booth. Thus, the air supply chamber 12 is downsized. Furthermore, by virtue of the flow-straightening devices 20 straightening the flow of air with the plurality of fins 21, periodical replacement as with a bag filter can be dispensed with, which leads to reduction in running costs.

Further, with the coating booth 10 and the flow-straightening device 20 according to the present embodiment, by virtue of the perforated plate 41 disposed downstream to the hopper part 17A of the coupling duct 17 and covering the plurality of fins 21 from the upstream side, the velocity of airflow passing between the fins 21 is reduced, whereby noise can be reduced. Further, in the coating booth 10, by virtue of provision of the hopper part 17A at the coupling portion between the air supply duct 16 and the air supply chamber 12, air from the air supply duct 16 can be diffused in the width direction Z of the air supply chamber 12 before reaching the perforated plate 41.

Still further, the coating booth 10 and the flow-straightening device 20 of the present embodiment are capable of causing air flowing along the fins 21 disposed farther from the floor wall 12B to flow out from a point farther in the depth direction of the air supply chamber 12 to the coating chamber 11, and causing air flowing along the fins 21 disposed nearer to the floor wall 12B to flow out from a point nearer in the depth direction of the air supply chamber 12 to the coating chamber 11. Thus, the air from the air supply duct 16 can be diffused in the depth direction X of the air supply chamber 12, and the air can be caused to flow from the entire air supply chamber 12 to the coating chamber 11. Furthermore, the fins 21 are provided with the intermediate ribs 25 and the sidewalls 26 projecting in the thickness direction Y of the air supply chamber 12 and extending in the depth direction of the air supply chamber 12. Accordingly, the fins 21 are reinforced by the intermediate ribs 25 and the sidewalls 26, and the flow of air passing between the fins 21 is facilitated in the depth direction X of the air supply chamber 12.

Second Embodiment

Figure 9:
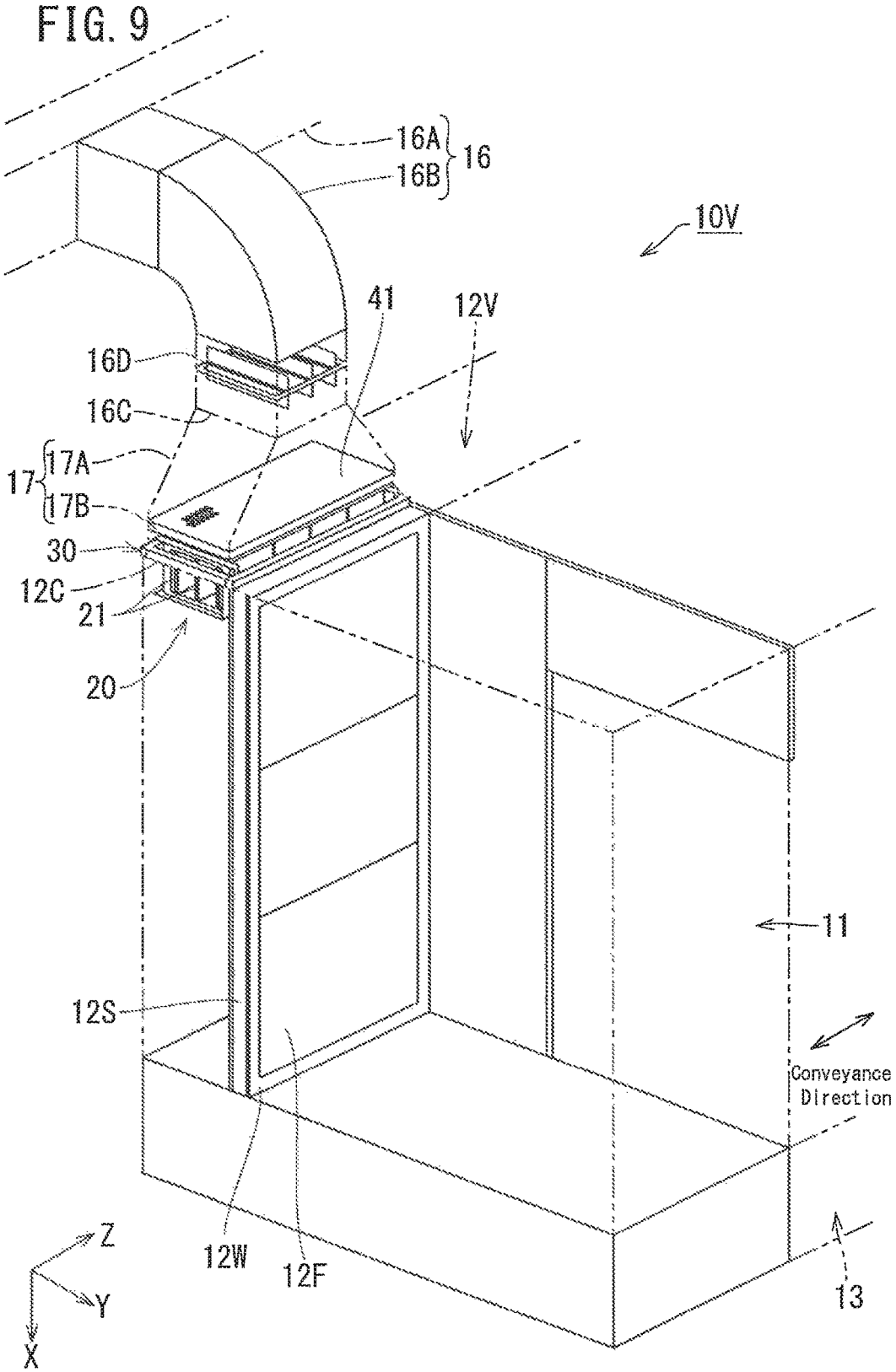
FIG. 9 is a perspective view of a coating booth according to a second embodiment.
Figure 10:
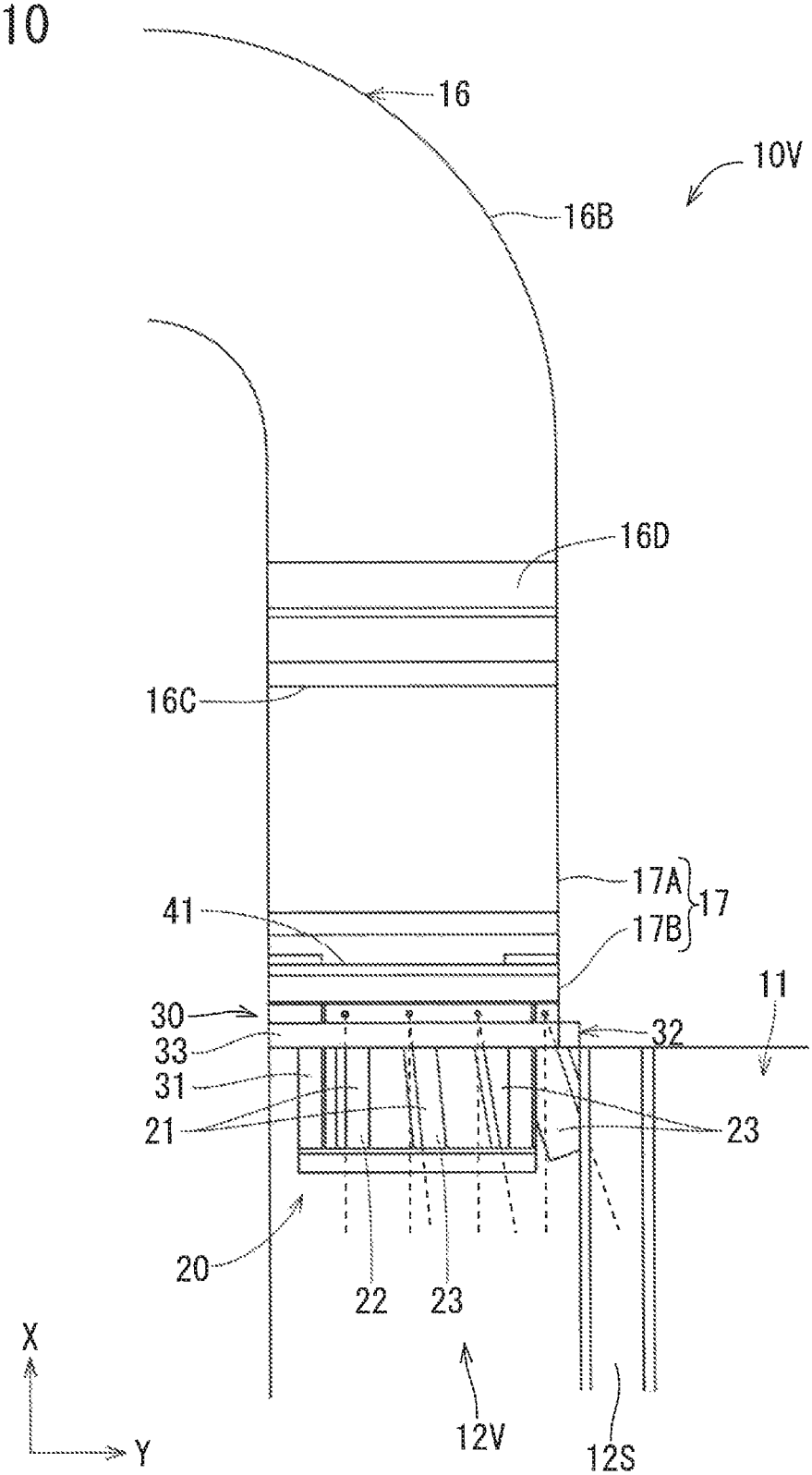
FIG. 10 is a diagram of a flow-straightening device as seen from a front side of the coating booth.

Hereinafter, with reference to FIGS. 9 and 10, a description will be given of a second embodiment of the present invention. As shown in FIG. 9, a coating booth 10V according to the present embodiment is different from the first embodiment in the arrangement of an air supply chamber 12V. Specifically, the air supply chamber 12V is adjacent to the coating chamber 11 in the short-side direction of the coating booth 10V (the direction perpendicular to the conveyance direction of a workpiece), and supplies air into the coating chamber 11 via a lateral wall 12S (corresponding to the "boundary wall" of the present invention). The side wall 12S is structured similarly to the floor wall 12B of the air supply chamber 12 according to the first embodiment, and the filter 12F is attached inside the filter frame 12W. In the example of the present embodiment, the exhaust chamber 13 is provided under the coating chamber 11, but the exhaust chamber 13 may be provided at a position so as to oppose to the air supply chamber 12V in the short-side direction of the coating booth 10V.

At the upper part of the air supply chamber 12V, a plurality of air inlets 12C are formed in the long-side direction of the coating booth 10V. The air supply duct 16 according to the present embodiment may have any shape as long as it includes a plurality of vents 16C opposing to the plurality of air inlets 12C. In the exemplary structure shown in FIG. 9, the main pipe 16A of the air supply duct 16 is disposed above the air supply chamber 12V, and the branch pipe 16B has an elbow shape, that is, branching laterally from the main pipe 16A and curved downward toward the air supply chamber 12V. In the present embodiment, the depth direction X of the air supply chamber 12V as seen from the vent 16C of the air supply duct 16, that is, the height direction of the coating booth 10V, corresponds to the "air supply chamber depth direction" of the present invention; the width direction Z perpendicular to the depth direction X within a plane parallel to the side wall 12S (that is, the long-side direction of the coating booth 10) corresponds to the "air supply chamber width direction" of the present invention; and the thickness direction Y perpendicular to the side wall 12S (that is, the short-side direction of the coating booth 10V) corresponds to the "air supply chamber thickness direction" of the present invention. Hereinafter, in the present embodiment, unless otherwise specified, the depth of the air supply chamber 12V refers to the length in the depth direction X (the height direction of the coating booth 10V), and the width of the air supply chamber 12V refers to the length in the width direction Z (the long-side direction of the coating booth 10V).

In the coating booth 10V, the flow-straightening device 20 are disposed above the air supply chamber 12V. The arrangement of a plurality of fins 21 and the perforated plate 41 in the flow-straightening device 20 is similar to that in the first embodiment. That is, the plurality of fins 21 are disposed in the width direction Z of the air supply chamber 12V (the long-side direction of the coating booth 10V) and the depth direction X (the height direction of the coating booth 10V) of the air supply chamber 12V as being spaced apart from each other in the thickness direction Y of the air supply chamber 12V (in the short-side direction of the coating booth 10V). As shown in FIG. 10, in the plurality of fins 21, the first fin 22 disposed farthest from the side wall 12S from the air supply chamber 12V is disposed substantially parallel to the side wall 12S, and the plurality of second fins 23 disposed nearer to the side wall 12S than the first fin 22 increasingly tilt toward the side wall 12S with increases in distance in the depth direction of the air supply chamber 12V. Further, the perforated plate 41 is disposed so as to cover the plurality of fins 21 from the upstream side over the entire width direction Z of the air supply chamber 12V.

Note that, in the coating booth 10V according to the present embodiment, just one flow-straightening device 20 is provided and the guide plates 45 (for example, see FIG. 4 according to the first embodiment) are not provided. Other detailed structure of the coating booth 10V and the flow-straightening device 20 is similar to that in the first embodiment and, therefore, the detailed description thereof is omitted herein.

The foregoing is the description of the structure of the coating booth 10V according to the present embodiment. The coating booth 10V according to the present embodiment can exhibit the effect similar to that in the first embodiment.

Other Embodiments

The present invention is not limited to the embodiments described above. For example, the embodiments described in the following are also included in the technical scope of the present invention. Other various modifications of the present invention can be made within the range not departing from the spirit of the present invention.

Figure 11:
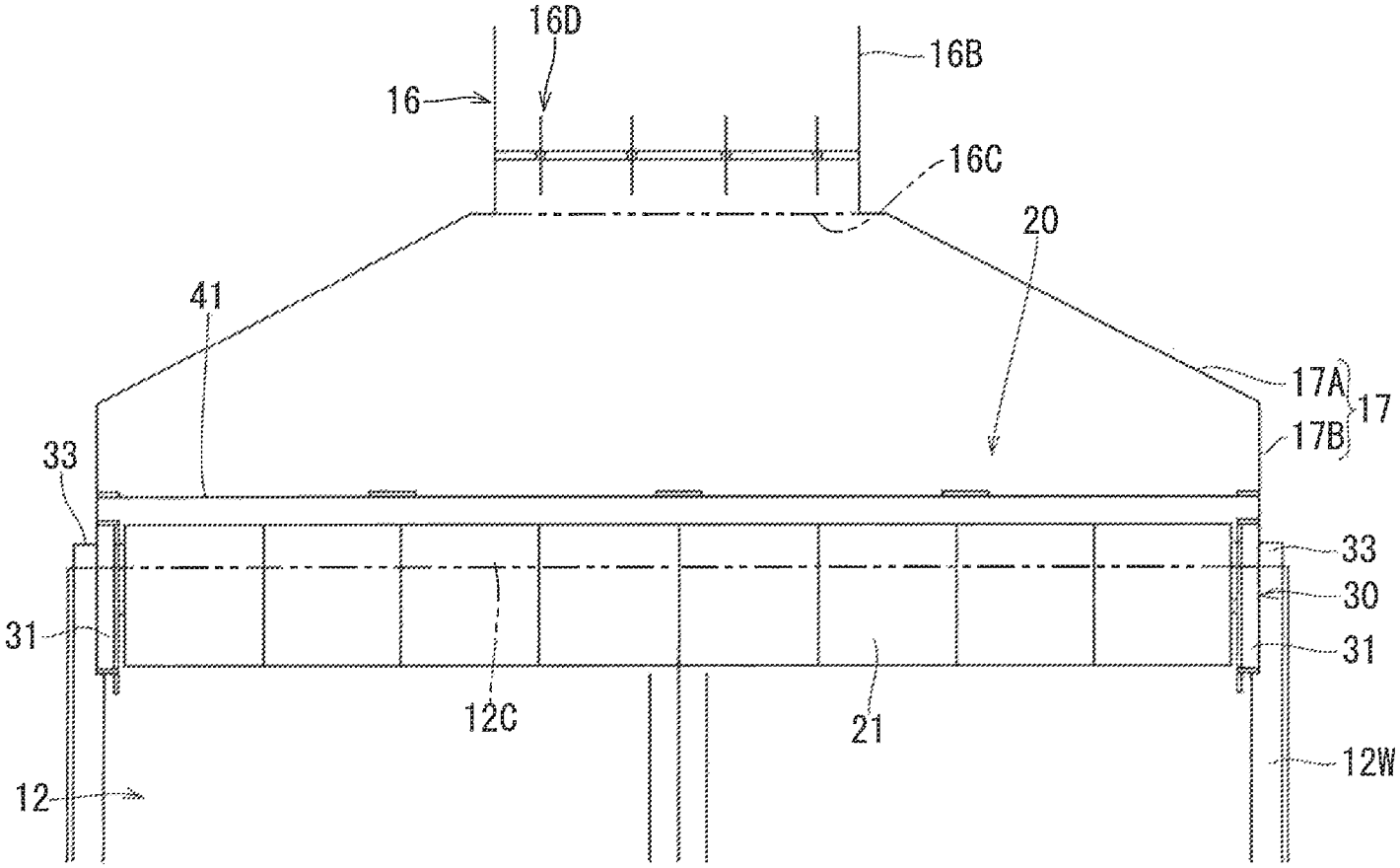
FIG. 11 is a plan view of a flow-straightening device according to a variation.

(1) In the first embodiment, in the case where the air inlet 12C of the air supply chamber 12 is small in width, as shown in FIG. 11, the flow-straightening device 20 may be provided just one in number. In this case, the blocking wall 35 is not formed. Further, FIG. 11 shows the flow-straightening device 20 and its surrounding in an enlarged manner, and the width of the air inlet 12C of the air supply chamber 12 shown in FIG. 11 is smaller than the width of the air inlet 12C of the air supply chamber 12 shown in FIG. 7.

(2) In the first embodiment, the flow-straightening devices 20 are provided by two in number, but the flow-straightening devices 20 may be provided by three or more in the case where the width of the air inlet 12C of the air supply chamber 12 is large. Further, in the second embodiment, in the case where the width of the air inlet 12C of the air supply chamber 12V is large, a plurality of flow-straightening devices 20 may be provided.

(3) In the embodiments, the flow-straightening device 20 includes four fins 21, but the number of the fins 21 is not particularly limited as long as the flow-straightening device 20 includes a plurality of fins 21. For example, the fins 21 may be three, or five or more in number.

(4) In the embodiments, the intermediate ribs 25 may project upward, and the sidewalls 26 may project downward.

(5) In the embodiments, claws 27 are formed for reinforcing the fins 21, but the fins 21 may not include the claws 27 when the fins 21 do not require reinforcement.

Figure 12:
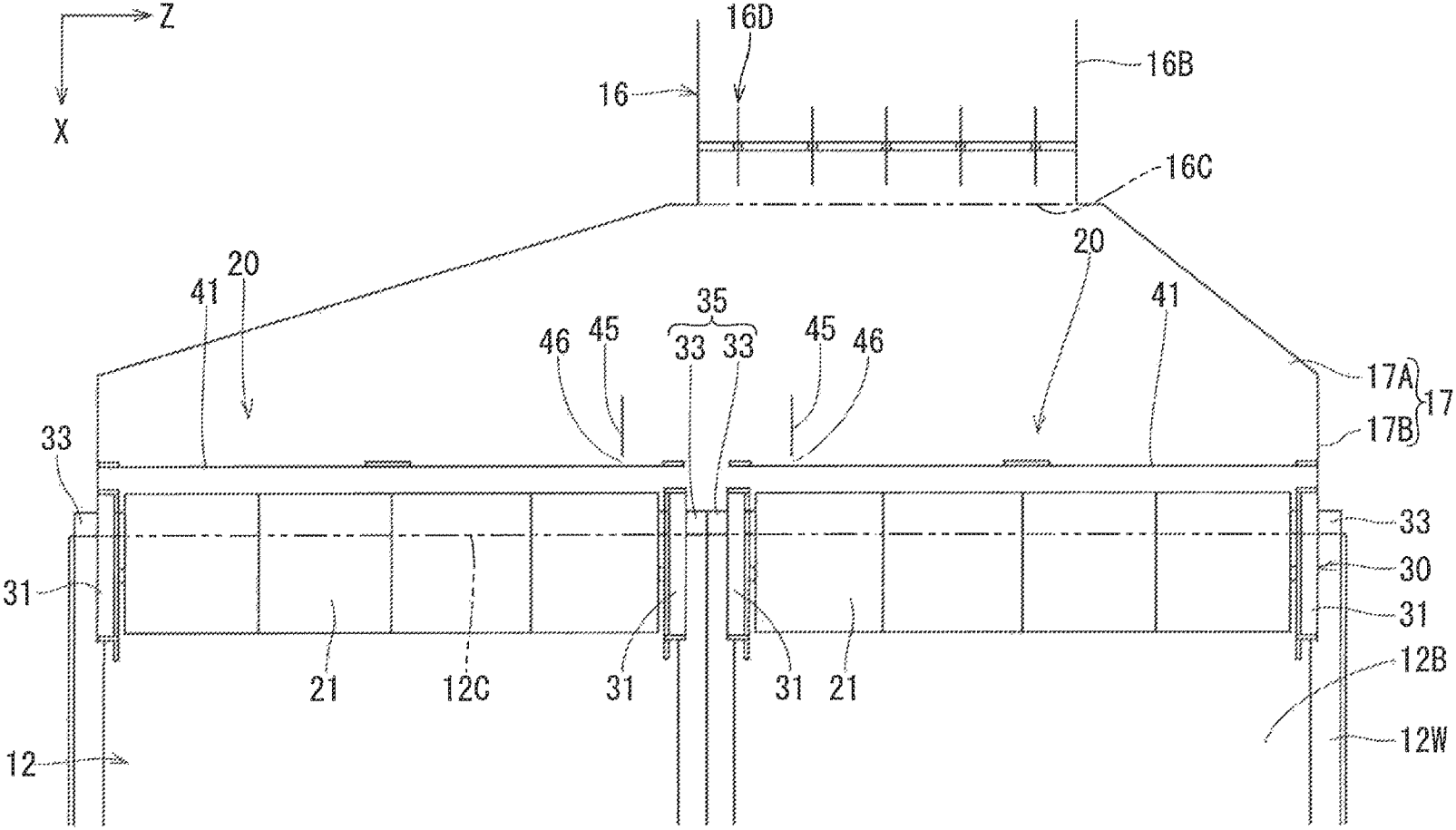
FIG. 12 is a plan view of the flow-straightening device according to the variation.

(6) In the embodiments, the center of the vent 16C and the center of the air inlet 12C coincide with each other in the width direction of the air supply chamber 12, but as shown in FIG. 12, the vent 16C may be eccentrically disposed relative to the center of the air inlet 12C.

Figure 13:
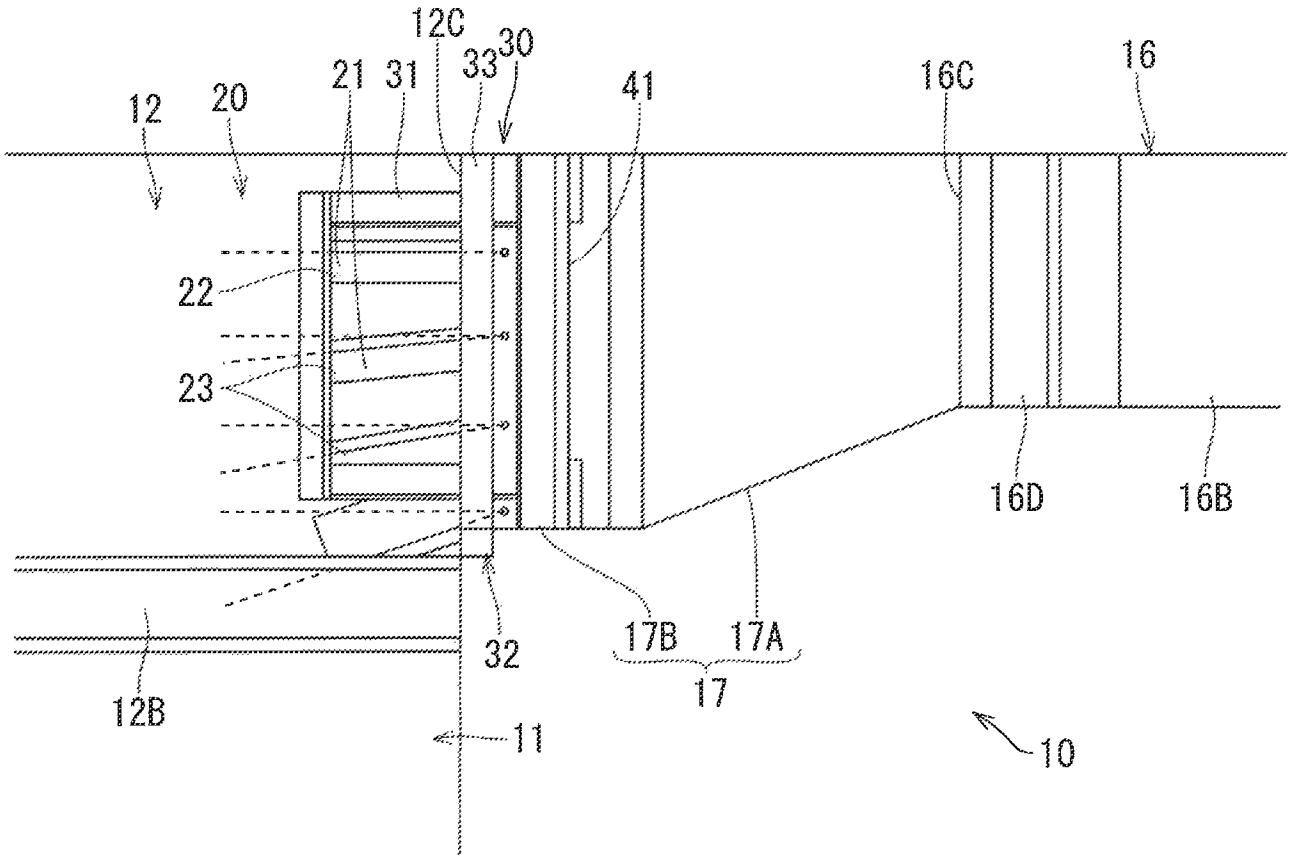
FIG. 13 is a side view of the flow-straightening device according to the variation.

(7) In the first embodiment, the height of the vent 16C of the air supply duct 16 in the height direction of the air supply chamber 12 is identical to the height of the air inlet 12C of the air supply chamber 12, but as shown in FIG. 13, in the case where the height of the vent 16C of the air supply duct 16 is lower than the height of the air inlet 12C, the hopper part 17A of the coupling duct 17 may be increased in height with increases in a distance in the downstream direction. Note that, it is preferable to dispose the top end of the vent 16C and the top end of the air inlet 12C at the substantially same position, and to tilt the bottom wall of the hopper part 17A. Note that, the present structure may be applied to the second embodiment. In this case, the end of the vent 16C and the end of the air inlet 12C both being farther from the side wall 12S are preferably disposed at the substantially same position.

(8) In the embodiments, the flow-straightening device 20 may not include the perforated plate 41.

(9) In the embodiments, the coupling duct 17 is structured of the hopper part 17A and the straight part 17B, but the coupling duct 17 may be structured of just the straight part 17B.

REFERENCE SIGNS LIST

10, 10V: coating booth
11: coating chamber
12, 12V: air supply chamber
12B: floor wall (boundary wall)
12S: side wall (boundary wall)
16: air supply duct
17: coupling duct
17A: hopper part (channel widened part)
20: flow-straightening device
21: fin
22: first fin
23: second fin
25: intermediate rib (flow-straightening projection wall)
26: sidewall (flow-straightening projection wall)
35: blocking wall
41: perforated plate (porous plate)
45: guide plate

The invention claimed is:

1. A flow-straightening device provided at a coupling portion between: an air supply chamber adjacent to a coating chamber and supplying air to the coating chamber via a filter provided at a boundary wall between the air supply chamber and the coating chamber; and an air supply duct supplying air to the air supply chamber in a direction along the boundary wall, the flow-straightening device comprising a plurality of fins extending in an air supply chamber width direction and an air supply chamber depth direction and arranged to be spaced apart from each other in an air supply chamber thickness direction, wherein a depth direction of the air supply chamber as seen from an air supply direction from the air supply duct is the air supply chamber depth direction; a direction parallel to the boundary wall and perpendicular to the air supply chamber depth direction is the air supply chamber width direction; and a direction perpendicular to the boundary wall is the air supply chamber thickness direction, wherein the plurality of fins include a first fin disposed substantially parallel to the boundary wall, and a plurality of second fins positioned nearer to the boundary wall than the first fin is, the plurality of second fins increasingly tilting toward the boundary wall with increases in distance in the air supply chamber depth direction, and in the plurality of second fins, the second fin nearer to the boundary wall has a greater tilt angle relative to a plane parallel to the boundary wall.

2. The flow-straightening device according to claim 1, further comprising a porous plate having a plurality of through holes and covering the plurality of fins from an upstream side.

3. The flow-straightening device according to claim 1, wherein the plurality of fins are provided with a flow-straightening projection wall projecting in the air supply chamber thickness direction and extending in the air supply chamber depth direction.

4. A coating booth comprising:

the air supply chamber;

the air supply duct; and the flow-straightening device according to claim 1 provided at the coupling portion between the air supply duct and the air supply chamber.

5. A coating booth comprising:

an air supply chamber adjacent to a coating chamber and supplying air to the coating chamber via a filter provided at a boundary wall between the air supply chamber and the coating chamber;

an air supply duct supplying air to the air supply chamber in a direction along the boundary wall; and a flow-straightening device provided at a coupling portion between the air supply duct and the air supply chamber, the flow-straightening device including a plurality of fins extending in an air supply chamber width direction and an air supply chamber depth direction and arranged to be spaced apart from each other in an air supply chamber thickness direction, wherein a depth direction of the air supply chamber as seen from an air supply direction from the air supply duct is the air supply chamber depth direction; a direction parallel to the boundary wall and perpendicular to the air supply chamber depth direction is the air supply chamber width direction; and a direction perpendicular to the boundary wall is the air supply chamber thickness direction, wherein at the coupling portion between the air supply duct and the air supply chamber, a channel widened part is provided upstream to the plurality of fins, a width of the channel widened part increasing in the air supply chamber width direction with increases in a downstream direction, and the flow-straightening device includes a porous plate having a plurality of through holes, the porous plate being positioned downstream to the channel widened part and covering the plurality of fins from an upstream side.

6. A coating booth comprising:

an air supply chamber adjacent to a coating chamber and supplying air to the coating chamber via a filter provided at a boundary wall between the air supply chamber and the coating chamber;

an air supply duct supplying air to the air supply chamber in a direction along the boundary wall; and a flow-straightening device provided at a coupling portion between the air supply duct and the air supply chamber, the flow-straightening device including a plurality of fins extending in an air supply chamber width direction and an air supply chamber depth direction and arranged to be spaced apart from each other in an air supply chamber thickness direction, wherein a depth direction of the air supply chamber as seen from an air supply direction from the air supply duct is the air supply chamber depth direction; a direction parallel to the boundary wall and perpendicular to the air supply chamber depth direction is the air supply chamber width direction; and a direction perpendicular to the boundary wall is the air supply chamber thickness direction, wherein a plurality of the flow-straightening devices are disposed juxtaposed to each other in the air supply chamber width direction, and a blocking wall blocking air flowing from the air supply duct to the air supply chamber is formed at a boundary portion between the flow-straightening devices adjacent to each other, and the plurality of flow-straightening devices are provided with a pair of guide plates positioned upstream to the blocking wall and opposing to each other in the air supply chamber width direction to have the blocking wall interposed between the guide plates.

* * * * *